United States Patent [19]

Celette

[11] Patent Number: 4,989,339

[45] Date of Patent: Feb. 5, 1991

[54] APPARATUS FOR USE ON AN ALIGNMENT BENCH FOR ALIGNING AND RESTORING DAMAGED VEHICLES

[75] Inventor: Germain Celette, Vienne, France

[73] Assignee: Celette GmbH, Fed. Rep. of Germany

[21] Appl. No.: 421,125

[22] Filed: Oct. 13, 1989

[30] Foreign Application Priority Data

Oct. 15, 1988 [DE] Fed. Rep. of Germany ..... 3835270

[51] Int. Cl.[5] ..... G01D 21/00

[52] U.S. Cl. ..... 33/608; 33/288

[58] Field of Search ..... 33/608, 613, 644, 600, 33/288, 546, 552; 72/705

[56] References Cited

U.S. PATENT DOCUMENTS

| | | | |
|---|---|---|---|
| 3,869,804 | 3/1975 | Friend | 33/288 |
| 4,400,969 | 8/1983 | Specktor | 72/457 |
| 4,498,242 | 2/1985 | Celette | 33/600 |
| 4,513,508 | 4/1985 | Jarman et al. | 33/288 |
| 4,598,481 | 7/1986 | Donahue | 33/288 |
| 4,601,105 | 7/1986 | Yamazaki et al. | 33/608 |
| 4,731,936 | 3/1988 | Aldrich et al. | 33/608 |
| 4,873,861 | 10/1989 | Bergstrom | 72/457 |

FOREIGN PATENT DOCUMENTS

| | | | |
|---|---|---|---|
| 0165115 | 7/1987 | Japan | 33/608 |

*Primary Examiner*—Thomas B. Will

*Attorney, Agent, or Firm*—Wall and Roehrig

[57] ABSTRACT

A terminal alignment angle set part or end piece for use in a multi-Z-receptor or tower of an alignment bench comprising a frame constructed of sectional pieces on which are disposed one or more towers carrying a head piece thereon, the terminal alignment angle set part, or head pieces, being constructed such that at least two of the head pieces may be operatively connected for sliding and rotationable positioning and be fixed relative to one another and the tower to provide for the simultaneous locating or verification of two points on a motor vehicle body through a single tower or multi-Z-receptor.

6 Claims, 2 Drawing Sheets

APPARATUS FOR USE ON AN ALIGNMENT BENCH FOR ALIGNING AND RESTORING DAMAGED VEHICLES

BACKGROUND OF THE INVENTION

This invention relates to an apparatus for use with a vehicle position alignment-angle verification and positioning system for multi-Z-receptors which locate the XYZ dimensional coordinate values of datum points on a vehicle to be checked, reformed or verified in order that such datum points be correctly positioned relative to an alignment bench upon which the vehicle has been secured.

This invention relates to a terminal part or end piece of a set of parts used to determine or maintain a predetermined positional alignment of a point on a vehicle relative to an alignment bench upon which the vehicle has been secured. The end pieces are a part of a multi-Z-receptor set for locating and maintaining the XYZ dimensional co-ordinates of a desired predetermined position relative to the bench, for aligning and restoring the damaged motor vehicle body to proper specifications.

To restore or reconstruct damaged vehicle bodies or body parts, various configured end or head pieces are used in cooperation with an alignment bench, whereby the spatial position of various vehicle components can be determined relative to the alignment bench upon which the vehicle is mounted. In that manner, such datum points may be compared to pre-determined specifications for the proper position of such point.

Such alignment benches comprise, in general, a frame constructed of sectional pieces upon which the end or head pieces for performing such functions are disposed. The alignment bench frame comprises longitudinal frame members, along which the parts for checking, securing or reforming the vehicle body may be positioned, with the terminal or end pieces being fixable in predetermined positions relative to a column or tower which is fastened appropriately on the bench frame to permit the end pieces to function as multi-Z-receptors. Such an arrangement is described, for example, in DE-GM (utility patent) 87 08 639.5. See also U.S. Pat. No. 4,781,045 which discloses a vehicle repair system wherein a common base is securable to an alignment bench and may utilize a plurality of control heads for various different vehicles which may be used interchangeably in the common base for locating the position of components of such vehicles for securing that component or reforming the component to a pre-determined specification.

In using such systems to check a pre-determined datum point on a vehicle body, the terminal or end pieces which verify the positional alignment must be positioned relative to the alignment bench upon which the vehicle is secured such that the datum point of the vehicle, when that portion of the vehicle corresponds to specifications, will rest precisely on the portion of the terminal or end piece which corresponds to the predetermined positional alignment desired. It has been found, however, that it is sometimes necessary to locate two points on a vehicle body which are closely adjacent to each other. In such a case it has been difficult to utilize separate terminal end pieces, or head pieces as they are sometimes called, when each is separately supported on a base or tower to verify the location of two closely adjacent points on a vehicle body at the same time.

The present invention permits the combining of at least two of such terminal end pieces, or head pieces, on a single base or tower so that the end pieces can be used to locate, secure or reform datum points on a vehicle body which are located closely adjacent to each other at the same time.

SUMMARY OF THE INVENTION

The present invention permits a single base or tower to be secured to the alignment bench and have connected thereto at least two terminal end pieces, or head pieces, with one of the end pieces operatively connected to another end piece such that both head pieces are carried by a single tower or base for simultaneously checking or securing at least two datum points on a vehicle body.

With the head pieces of the present invention, two points on a vehicle body close to each other may be checked at the same time, without necessitating a second tower or base which might not be accommodated in terms of space on the alignment bench. In this manner only one multi-Z-receptor tower is required. The single tower or base is secured to the alignment bench, and the two end or head pieces inserted into the tower for checking the positional location of two desired datum points on a vehicle.

With the alignment angle set according to the invention the essential advantages achieved at two points of the vehicle body lined closed to each other are checkable whereas a second tower or base could not be accommodated in terms of space. Further, for this double checking only one multi-Z-receptor is required, thereby simplifying the equipment needed to be used on the alignment bench. The two operatively connected end pieces can be developed in any manner at the upper side, and be provided with appropriately arranged bores to reach the desired datum points on the motor vehicle body the specific positional location of which will depend upon the particular motor vehicle body upon which such operation is being performed.

DESCRIPTION OF THE DRAWINGS

In conjunction with the drawing, the terminal alignment angle set part according to the invention will be elucidated using a preferred embodiment by example. Therein.

DESCRIPTION OF A PREFERRED EMBODIMENT

Figure 1:
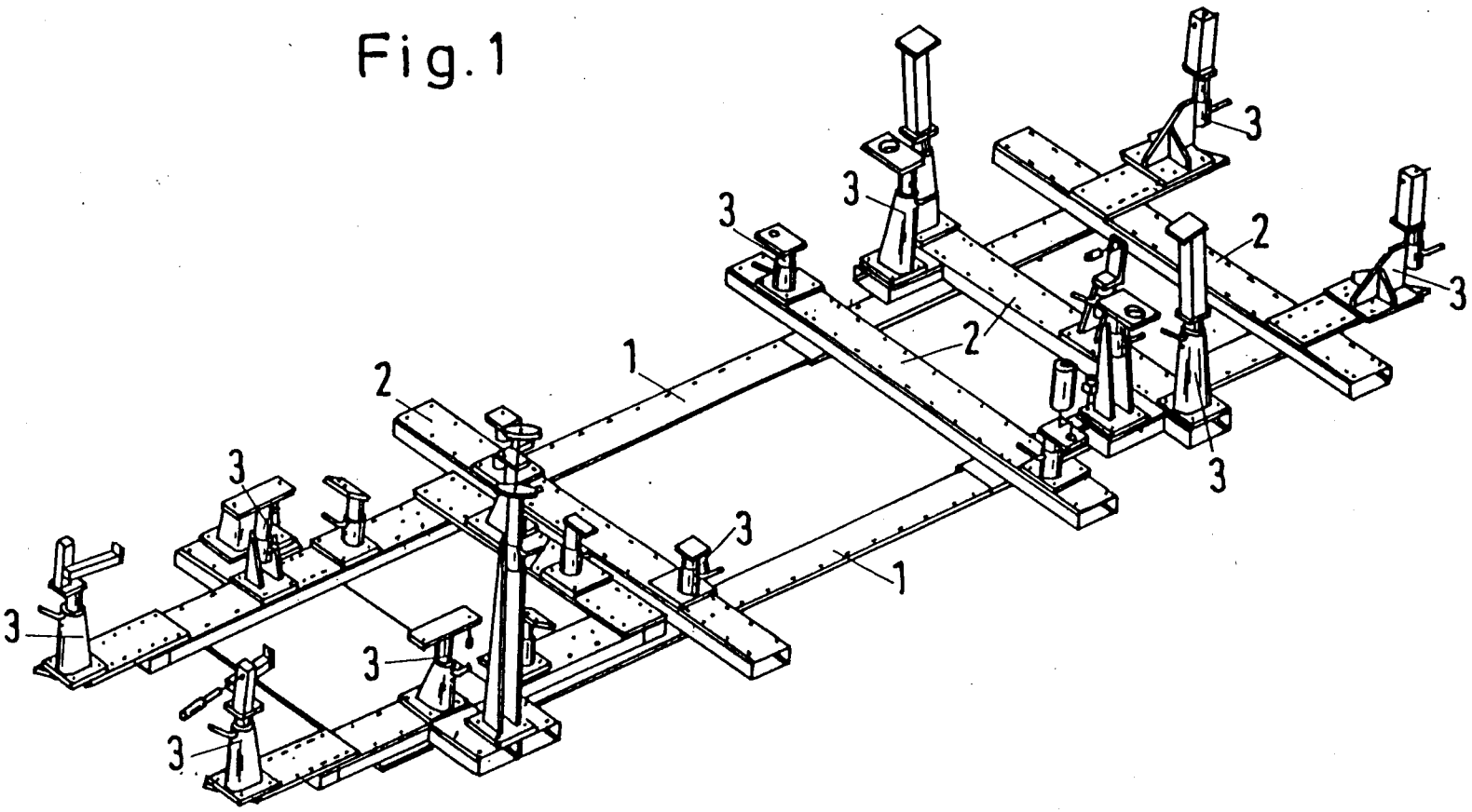
FIG. 1 shows a perspective view of an alignment bench with carriers in the form of multi-Z-receptors disposed thereupon.
Figure 4:
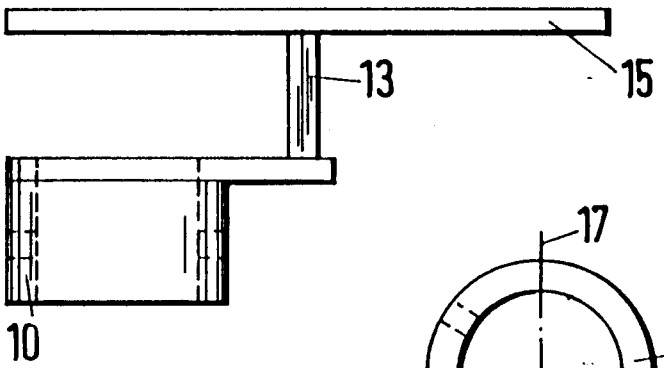
FIG. 4 shows the second element of the terminal alignment angle set according to the invention in lateral view.

As is evident in FIG. 1, an alignment bench in which the terminal alignment angle set part or positional alignment determining end pieces, according to the invention can be used comprising a frame constructed of two profile or longitudinally extending sections 1 and sectional pieces 2 extending transversely thereacross, each of which is provided on the upper side thereof with holes to which are affixed carriers 3. The carriers 3 are sometimes referred to as bases or towers. Further details of such an alignment bench are disclosed in the aforementioned patents as well as in U.S. Pat. No. 4,242,803.

On the alignment bench or frame are disposed, from the front towards the rear, several elements of an alignment angle set positioned on the scale of the required modular dimension of the transverse and longitudinal carriers. These alignment angle set parts are sometimes referred to as terminal end pieces, or head pieces, which are carried by towers. The shape of a particular head piece is determined by the spatial location of the datum point of a particular vehicle body which is to be checked and/or repaired.

As previously discussed, it can occur that on a particular motor vehicle body datum points positioned closely together must be checked, which are located such that two multi-Z-receptors or towers cannot be accommodated on the alignment bench in terms of space in order to position two head pieces located at the predetermined specifications for the vehicle body relative to the alignment bench. To overcome this problem, the instant terminal alignment angle set part invention, or head pieces, can be set into any of the towers or bases 3 of the alignment bench as, for example, described in FIGS. 2 to 5.

These operatively connected end pieces comprise a horizontally extended arm 5 extending outwardly from one element 4 of the position alignment head and having at an external end thereof a bore 6 extending perpendicularly to the arm 5 for receiving a portion of the vehicle body. At the other end of the arm 5 is a cylindrical column 7 extending vertically therefrom and having formed therein two bores 8 and 9 which extend transversely through the column 7. The column 7 is sized such that a second element or end piece 10 having a sleeve 10' formed with a transverse bore 11 to permit relative vertical movement between the sleeve 10' and the column 7. A second arm 12 is secured to the sleeve 10' and extends horizontally therefrom and carries at the external end thereof a T-shaped piece 13 with the stem thereof extending upwardly with a transverse bar 15 projecting above the first arm 5 of the end piece 4.

The arm 12 is fixable relative to the column 7 by means of a plug pin 14 which is inserted through the transverse bore 11 in the sleeve 10 and through a companion locating bore or the hole 8 in column 7. The coupled head pieces, 4 and 10, are then fixed on the tower 3 by means of a second plug pin 16 which is passed through the transverse locating bore 9 formed in the column 7 when positioned within a guide portion of the tower which has a corresponding locating bore formed therethrough.

Figure 5:
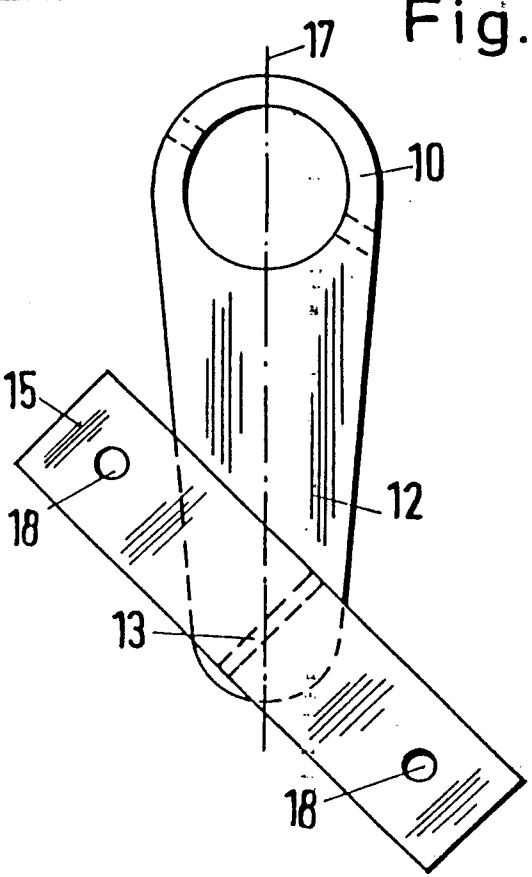
FIG. 5 shows the second element according to FIG. 4 in a top view.
Figure 2:
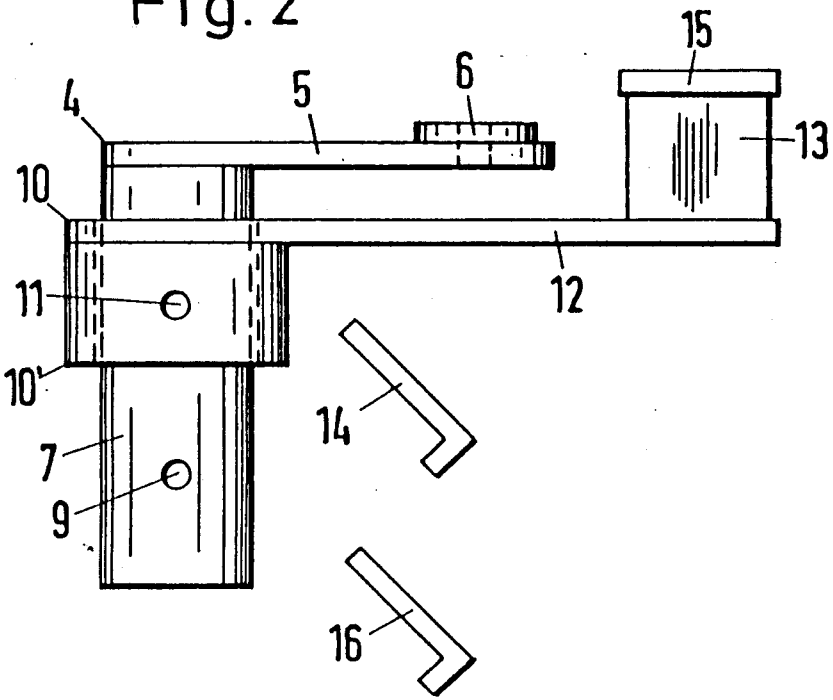
FIG. 2 shows a terminal alignment angle set part according to the invention in lateral view.
Figure 3:
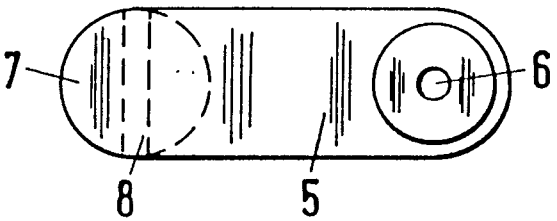
FIG. 3 shows an element of the alignment angle set according to the invention in top view.

As best shown in FIG. 5, the transverse bar 15 extends transversely to an axis 17 of the second head 10. At the ends of the transverse bar 15 are bores 18 through which bolts may be inserted for fixing or securing a pre-determined portion of the vehicle body to the transverse bar. With the two head pieces being positioned in the manner described, two datum points on a motor vehicle body which lie close to one another can be checked or secured at the same time through the use of a single multi-Z-receptor or tower. While for convenience of illustration a specific configuration of the end pieces 4 and 10 has been described with detail, it is to be understood that the particular configuration of said end pieces will be dictated by the specific motor vehicle body which is to be serviced and accordingly may utilize different shapes, configurations and holes in accordance with the specifications associated with a particular motor vehicle body to locate the desired datum points.

While the invention has been described in the specification and illustrated in the drawings which reference to a preferred embodiment, it will be understood by those skilled in the art that various changes may be made and equivalents may be substituted for elements of the invention without departing from the scope of the claims. In addition, many modification may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. In a vehicle repair system for verifying and securing the correct location of components of a damaged vehicle wherein the vehicle is secured to a checking bench having a plurality of spaced fastening holes formed therein for mounting locating devices to verify and secure the correct position of vehicle components during a repair process, the locating devices including a single tower base secured to the checking bench through the spaced fastening holes and having an opening therein for receiving a portion of a first end piece configured in accordance with the location of a first datum point relative to the damaged vehicle secured to the checking bench, the first end piece being securable to the single tower base in an orientation to position the first end piece at the location of said first datum point relative to the damaged vehicle, the improvement comprising a second end piece mounted directly to said first end piece when said first end piece is mounted upon said single tower base for locating a second datum point relative to the damaged vehicle wherein said first and second datum points are located off of said single tower base.

2. The vehicle repair system of claim 1 wherein said first end piece is formed with a stem portion having a position locating bore extending transversely through said stem portion, said tower base is formed with a bore extending transversely therethrough in a position relative to said tower base such that upon securing of the tower base onto the checking branch and the coaxial positioning of the bore formed in said stem portion and the bore formed in said tower base will position said first end piece in the location of said first datum point relative to said damaged vehicle, and securing means positionable through said coaxially aligned bores to connect said first end piece to said tower base.

3. In a vehicle repair system for verifying and securing the correct location of components of a damaged vehicle wherein the vehicle is secured to a checking bench having a plurality of spaced fastening holes formed therein for mounting locating devices to verify and secure the correct position of vehicle components during a repair process, the locating devices including a first end piece, formed with a stem portion having a position locating bore extending transversely through said stem portion, a tower base secured to the checking bench through the spaced fastening holes and including a guide portion formed with a bore extending transversely therethrough in a position relative to said tower base such that upon the securing of the tower base onto the checking bench and the coaxial positioning of the bore formed in said stem portion and the bore formed in said tower base, when said first end piece is secured in said guide portion, will position said first end piece in a first pre-determined position relative to said damaged vehicle at a first datum point on the vehicle, the improvement comprising a second end piece directly connected to said first end piece and including a collar portion having an opening therein through which said stem portion of said first end piece is positionable, said collar portion being formed with a locating bore extending transversely therethrough, said stem portion of said first end piece having a companion locating bore formed therethrough, said locating bore and said companion locating bore being formed in said collar portion and said stem portion, respectively, at a position such that coaxial alignment of said locating and companion bores positions and second end piece in a second predetermined location relative to said first end piece at a second datum point on the vehicle, and means insertable through said coaxially aligned locating bores formed on said stem portion and said collar portion for securing said second end piece to said first end piece.

4. The vehicle repair system of claim 3 wherein said first end piece has an outwardly extending arm having a terminal end formed with a bore extending vertically therethrough for locating said first position on the vehicle mounted on the checking bench, or for securing the vehicle to said first end piece.

5. The vehicle repair system of claim 4 wherein said second end piece includes an outwardly extending arm having an end portion to which is secured a T-shaped piece, and said T-Shaped piece having a web portion extending upwardly from said arm a length sufficient to position a transversely extending bar of said T-shaped piece above the arm of said first end piece when the companion locating bore of said first end piece is coaxially aligned with the locating bore formed in said collar portion of said second end piece.

6. The vehicle repair system of claim 5 wherein said transversely extending bar of said T-shaped piece extends obliquely to the longitudinal axis of said outwardly extending arm upon which it is supported, and said T-shaped, piece is formed with an opening in each end thereof for securing or fixing the damaged vehicle to the transverse bar.

* * * * *